US009514854B2

(12) United States Patent
Pahlke et al.

(10) Patent No.: US 9,514,854 B2
(45) Date of Patent: Dec. 6, 2016

(54) X-RAY RADIATION PASSAGE WINDOW FOR A RADIATION DETECTOR

(71) Applicant: KETEK GmbH, Munich (DE)

(72) Inventors: Andreas Pahlke, Munich (DE); Reinhard Fojt, Berg (DE); Natsuki Miyakawa, Munich (DE)

(73) Assignee: KETEK GmbH, Munich (DE)

( * ) Notice: Subject to any disclaimer, the term of this patent is extended or adjusted under 35 U.S.C. 154(b) by 312 days.

(21) Appl. No.: 13/963,928

(22) Filed: Aug. 9, 2013

(65) Prior Publication Data

US 2014/0044240 A1 Feb. 13, 2014

(30) Foreign Application Priority Data

Aug. 9, 2012 (DE) ..... 10 2012 107 342

(51) Int. Cl.

| | |
|---|---|
| ***G21K 1/00*** | (2006.01) |
| ***H01J 5/18*** | (2006.01) |
| *H01J 35/18* | (2006.01) |

(52) U.S. Cl.

CPC . *G21K 1/00* (2013.01); *H01J 5/18* (2013.01); *H01J 35/18* (2013.01); *H01J 2235/18* (2013.01); *H01J 2235/183* (2013.01)

(58) Field of Classification Search

CPC ..... C07C 1/20; G01T 1/2928; G21K 1/00; H01J 5/18; H01J 35/18; H01J 2235/18; H01J 2235/183

USPC ..... 378/140, 161; 250/505.1; 428/114, 138

See application file for complete search history.

(56) References Cited

U.S. PATENT DOCUMENTS

| | | | | |
|---|---|---|---|---|
| 4,929,763 | A | 5/1990 | Luetkens, Jr. et al. | |
| 5,352,897 | A * | 10/1994 | Horikawa et al. | 250/370.06 |
| 6,438,208 | B1 * | 8/2002 | Koller | G21K 5/04 378/140 |
| 7,016,462 | B1 * | 3/2006 | Keville et al. | 378/47 |
| 7,035,379 | B2 * | 4/2006 | Turner et al. | 378/140 |
| 2004/0125919 | A1 * | 7/2004 | Martinez | H01J 35/18 378/140 |
| 2009/0086923 | A1 | 4/2009 | Davis et al. | |
| 2010/0126660 | A1 | 5/2010 | O'Hara | |
| 2011/0311029 | A1 * | 12/2011 | Andersson | 378/161 |
| 2012/0025110 | A1 * | 2/2012 | Davis | H01J 35/18 250/505.1 |
| 2012/0032150 | A1 * | 2/2012 | Lippert et al. | 257/29 |
| 2012/0087476 | A1 | 4/2012 | Liddiard et al. | |

FOREIGN PATENT DOCUMENTS

| | | | | |
|---|---|---|---|---|
| DE | 102010046100 | * | 3/2012 | G01T 7/00 |
| DE | 102010046100 | A1 | 3/2012 | |

OTHER PUBLICATIONS

Machine translation of DE102010046100.*

(Continued)

*Primary Examiner* — Hoon Song

(74) *Attorney, Agent, or Firm* — Slater Matsil, LLP

(57) ABSTRACT

An X-ray radiation passage window can be used for a radiation detector. The X-ray radiation passage window for a radiation detector includes a radiation-transmissive window element. The radiation-transmissive window element contains graphene. Furthermore, a radiation detector including an X-ray radiation passage window, a method for producing an X-ray radiation passage window and a use of graphene are disclosed.

22 Claims, 11 Drawing Sheets

(56) References Cited

OTHER PUBLICATIONS

Graphite—Wikipedia, the free encyclopedia, [online], Mar. 1, 2012, [retrieved Nov. 10, 2015]. Retrieved from the Internet: <https://web.archive.org/web/20120301160919/https://en.wikipedia.org/wiki/Graphite>.*

* cited by examiner

X-RAY RADIATION PASSAGE WINDOW FOR A RADIATION DETECTOR

This application claims priority to German Patent Application 10 2012 107 342.2, which was filed Aug. 9, 2012 and is incorporated herein by reference.

TECHNICAL FIELD

An X-ray radiation passage window is specified, in particular an X-ray radiation passage window for a radiation detector. Furthermore, a radiation detector comprising an X-ray radiation passage window, a method for producing an X-ray radiation passage window and a use of graphene are specified.

BACKGROUND

Radiation detectors are known which have beryllium windows or polymer-based windows, such as, for example, so-called AP3.3 windows. Beryllium windows are used for example, for applications requiring high transmission of high-energy X-rays (for example, >1 keV), whereas polymer-based AP3.3 windows are preferably used for applications requiring high transmission of low-energy X-rays (for example, <1 keV).

Windows for radiation detectors are described in U.S. Pat. No. 4,929,763 A and German Patent Publication No. 10 2010 046 100 A1.

SUMMARY OF THE INVENTION

Some embodiments specify an X-ray radiation passage window for a radiation detector that has improved properties in comparison with conventional X-ray radiation passage windows. Further embodiments specify a radiation detector comprising an X-ray radiation passage window, a method for producing an X-ray radiation passage window and an advantageous use of graphene.

An X-ray radiation passage window in accordance with at least one embodiment comprises a radiation-transmissive window element. The X-ray radiation passage window may be, for example, an X-ray radiation entrance window and/or X-ray radiation exit window. By way of example, the X-ray radiation passage window may be a window for an X-ray radiation detector or emitter. The window element may be, in particular, a window element that is radiation-transmissive to X-ray radiation. Preferably, by contrast, the radiation-transmissive window element is non-transmissive to visible light. Furthermore, the radiation-transmissive window element contains graphene. By way of example, the radiation-transmissive window element may have at least one layer containing graphene. Furthermore, the radiation-transmissive window element may have a layer consisting of graphene.

Here and hereinafter, the graphene-containing layer or layer consisting of graphene may also be designated as graphene layer. In this case, the term "graphene" denotes, in particular, a structure having carbon atoms arranged in a honeycomb-like manner, wherein the individual carbon atoms are arranged in a substantially two-dimensional plane and have bonds to other neighboring carbon atoms which are arranged in the same plane. Preferably, the carbon atoms are predominantly $sp^2$-hybridized. By way of example, the graphene-containing layer may comprise or consist of a graphene multilayer construction, that is to say that the graphene-containing layer may comprise or consist of a multilayer construction composed of graphene layers arranged one on another.

An X-ray radiation passage window comprising a window element having a graphene-containing layer is distinguished, in particular, by very good transmission for both low- and high-energy X-ray radiation. Furthermore, such an X-ray radiation passage window has a high hermetic impermeability (e.g., <3.10-10 mbar*L/s helium), a good mechanical stability (Δp>1 bar) and a good thermal stability (for example, >150° C. in gas, such as, for example, air, N2, Ar, or in vacuum).

In accordance with a further embodiment, the radiation-transmissive window element has at least one graphene-containing layer, wherein the graphene-containing layer has a layer thickness of greater than or equal to 100 nm. The graphene-containing layer may have a layer thickness of less than or equal to 230 nm. In accordance with one preferred embodiment, the graphene-containing layer has a layer thickness of greater than or equal to 100 nm and less than or equal to 230 nm. By way of example, the graphene-containing layer may have a plurality of so-called graphene monolayers or consist of a plurality of graphene monolayers. In this case, the term "graphene monolayer" denotes a substantially two-dimensional layer of carbon atoms having only bonds to neighboring carbon atoms in the same plane. The individual graphene monolayers may be embodied in particular in monocrystalline fashion. By way of example, the graphene-containing layer may comprise a number of at least 350 graphene monolayers or consist of a number of at least 350 graphene monolayers. By virtue of the fact that the graphene-containing layer comprises a plurality of graphene monolayers, the impermeability of the radiation-transmissive window element may be obtained even in the case of defects within individual graphene monolayers.

Advantageously, the graphene-containing window element is light-non-transmissive to visible light over the entire wavelength range. Furthermore, the window element has a good chemical resistance, for example to air, water or solvents, and an electrical conductivity required for an electrostatic dissipation. Furthermore, in contrast to beryllium, which is carcinogenic, graphene is non-toxic.

In accordance with a further embodiment, the radiation-transmissive window element has a plurality of layers, wherein at least one layer contains graphene or consists of graphene. By way of example, the radiation-transmissive window element may have a graphene-containing layer and a further layer, which blocks visible light. The layer that blocks visible light may for example contain aluminum or consist of aluminum. Incident optical light may be suppressed even better by the layer that blocks visible light.

In accordance with a further embodiment, the radiation-transmissive window element has a passivation layer besides the graphene-containing layer. The passivation layer may for example contain boron nitride or consist of boron nitride. The passivation layer may advantageously contribute to the improvement of the chemical resistance of the radiation-transmissive window element.

In accordance with a further embodiment, the radiation-transmissive window element can have a further, electrically conductive layer besides the graphene-containing layer. Said electrically conductive layer may contain aluminum or a conductive adhesive, for example. By means of the electrically conductive layer, the electrical conductivity of the radiation-transmissive window element may be increased even further for the purpose of electrostatic dissipation.

In accordance with a further embodiment, the radiation-transmissive window element has one or a plurality of graphene-containing layers or layers consisting of graphene. Furthermore, the radiation-transmissive window element may have one or a plurality of further layers, such as, for example, one or a plurality of the abovementioned light-blocking, electrically conductive or passivating layers. In this case, the individual graphene-containing layers or layers consisting of graphene may adjoin one another or else be separated from one another by one or more of the further layers.

In accordance with a further embodiment, the X-ray radiation passage window comprises a window holder element. Preferably, the radiation-transmissive window element is directly connected to the window holder element. The window holder element may comprise, for example, one or a plurality of materials which are preferably compatible with a process in which graphene is deposited onto one or onto a plurality of said materials. Preferably, the window holder element has a melting temperature of greater than or equal to 1,000° C., for example, under standard conditions. Furthermore, it is preferred for regions of the window holder element onto which graphene is deposited to comprise one or a plurality of materials or consist of one or a plurality of materials relative to which graphene has a good adhesion.

In accordance with a further embodiment, the materials contained in the window holder element may be structured with good selectivity relative to graphene. By way of example, production of supporting structures that stabilize the radiation-transmissive window element may be facilitated as a result.

By way of example, the window holder element contains at least one carbide-forming material. The window holder element may comprise at least one of the following materials or a combination thereof: Si, $SiO_2$, quartz, $Si_2N_4$, SiC, $Al_2O_3$, AN, Cu, Ni, Mo, W. Advantageously, the abovementioned materials prove to be particularly compatible relative to graphene deposition processes and may be structured with good selectivity relative to graphene.

In accordance with a further embodiment, the X-ray radiation passage window comprises one or a plurality of supporting structures. The supporting structures may, for example, contain the same materials as the window holder element or consist of the same materials as the window holder element. Furthermore, it is possible for the supporting structures to form part of the window holder element. By way of example, the supporting structures may be arranged on a side of the radiation-transmissive window element that faces the window holder element. In this case, the supporting structures may be directly connected to the radiation-transmissive window element.

Alternatively, the supporting structures may be arranged on a side of the radiation-transmissive window element that faces away from the window holder element, in which case they may be applied, for example, directly on the window element. In this case, the supporting structures may also comprise different materials than the window holder element. The supporting structures serve to mechanically stabilize the radiation-transmissive window element containing the graphene layer. Furthermore, it is possible for supporting structures to be formed within the graphene-containing layer. The supporting structures within the graphene-containing layer may be formed, for example by structuring, for example by elevations and depressions, of the graphene-containing layer. By virtue of the shaping of the graphene-containing layer, the latter may have an increased mechanical stability in comparison with a planar layer.

In accordance with a further embodiment, the window holder element is embodied as a cap. The cap may form, for example, together with the radiation-transmissive window element and a base connected to the cap, a detector housing of a radiation detector. Preferably, the cap comprises a metal or a ceramic. In accordance with a further embodiment, the cap comprises carbon. In accordance with a further embodiment, the cap is embodied as a TO8 cap that may form part of a so-called TO8 housing.

Advantageously, the X-ray radiation passage window described here has good integratability with housing parts to which the X-ray radiation passage window may be connected for example by means of adhesive bonding, soldering, or welding. A further advantage arises owing to the use of the graphene-containing window element on account of good availability of the carbon-containing starting materials required for production, such as methane, for example.

Furthermore, a radiation detector comprising an X-ray radiation passage window described here is specified. The radiation detector comprises, for example, a detector housing having an above-described X-ray radiation passage window and a detector element, which is arranged in the detector housing and which is suitable for detecting a radiation, in particular an X-ray radiation. Preferably, the detector housing forms a cavity which is closed off in a gas-tight manner and which may for example be evacuated or filled with protective gas. The radiation detector may be used, for example, for electron beam micro-analysis or X-ray fluorescence analysis.

In accordance with a further embodiment, the detector housing of the radiation detector comprises a base, a cap directly connected to the base, and an above-described radiation-transmissive window element. By way of example, a so-called TO8 housing is involved in this case.

Furthermore, a method for producing an X-ray radiation passage window, in particular an X-ray radiation passage window for a radiation detector, is specified, wherein the embodiments described above and below apply equally to the X-ray radiation passage window and to the method for producing the X-ray radiation passage window. In a first method step, a substrate is provided. Materials having good compatibility with a graphene deposition process are preferably used as substrate. By way of example, the substrate may comprise one of the following materials or a combination thereof: Si, $SiO_2$, quartz, $Si_2N_4$, SiC, $Al_2O_3$, AN, Cu, Ni, Mo, W. Furthermore, the substrate may be present for example as a foil, as a plate, such as, for example, as a wafer having, for example, a diameter of between 4" and 8", or as a cap or housing, such as, for example, as a TO8 cap or TO8 housing.

In a second method step, following the first method step, at least one layer which contains graphene or consists of graphene is deposited on at least one side of the substrate. By way of example, a CVD process (Chemical Vapor Deposition) is appropriate in this case as deposition process. In a further, third method step, at least one region of the substrate is subsequently removed. By way of example, wet-chemical etching or a Bosch process (reactive silicon ion depth etching) is used for removing the substrate material. After the removal of a substrate region, a beam path is formed by exposed regions of the graphene-containing layer. Furthermore, a membrane comprising graphene, also called graphene membrane hereinafter, is formed by the exposed regions and furthermore regions of the graphene-containing layer that are covered by substrate material, the said membrane forming the radiation-transmissive window element of the X-ray radiation passage window. The regions of the substrate that still remain and have not been removed from the window holder element of the X-ray radiation passage window.

The substrate may subsequently be singulated into individual X-ray radiation passage windows, which may be effected for example by means of wafer sawing, a laser process, a Bosch process or by a combination of the above-mentioned processes. As a result, in the context of the production process, a plurality of X-ray radiation passage windows arises from the substrate provided.

Preferably, the graphene-containing layer applied to the substrate has a layer thickness of greater than or equal to 100 nm. The graphene-containing layer may comprise, for example, a number of at least 350 graphene monolayers. As a result, even without additional light-blocking elements it is possible to achieve a good impermeability relative to visible light (approximately <1 ppm).

In accordance with a further embodiment, the beam path is provided with supporting structures by means of which the mechanical stability of the graphene membrane may advantageously be increased. In this case, the supporting structures may have, for example, the form of diagonal lines, parallel lattices, crosses, rings, triangles, cuboids, rhombi, circles, honeycombs or combinations thereof.

In accordance with a further embodiment, supporting structures are formed during the process of removing the substrate. The supporting structures may be embodied monolithically, for example, and may be formed for example by individual substrate regions that have not been removed.

In accordance with a further embodiment, before removing the substrate, supporting structures are applied on that side of the graphene-containing layer which faces away from the substrate. Preferably, the supporting structures are in this case applied directly on the graphene-containing layer.

In accordance with a further embodiment, the substrate is structured before the at least one graphene-containing layer is deposited. Preferably, the graphene-containing layer can be structured by the formation of geometrical shapes such as, for example, one or a plurality of concave cavities or one or a plurality of depressions, for example having rounded corners, or combinations thereof in the substrate. Preferably, the substrate is structured in one or a plurality of regions in which the substrate is removed after the graphene deposition. The mechanical stability of the graphene membrane may likewise be increased by means of the structuring of the substrate. Furthermore, by means of structuring the substrate, subsequently applying the graphene-containing layer and subsequently removing, preferably completely, specific regions of the substrate, it is possible to form supporting structures which for example contain regions of the graphene-containing layer or consist thereof.

In accordance with a further embodiment, the graphene-containing layer is structured after being deposited onto the substrate. By way of example, during the structuring of the graphene-containing layer, a plurality of depressions may arise within the layer. The depressions may, for example, have an identical depth in each case and be arranged equidistantly. Furthermore, the depressions may extend as far as to the substrate. Afterward, a graphene-containing layer may again be applied to the substrate, such that regions of the substrate arranged within the depressions, in particular, are covered with the graphene-containing layer. Regions of the substrate may then again be removed. Advantageously, it is thereby possible to form supporting structures within the graphene-containing layer.

The process methods used in the production method described, such as the CVD method, for example, are advantageously suitable for mass production. Furthermore, X-ray radiation passage windows produced by a production method described here have good results in quality inspections, for example owing to narrow thickness tolerances of the individual windows.

Furthermore, the use of graphene as component of an X-ray radiation passage window, in particular an X-ray radiation passage window of a radiation detector, is specified. In this case, it is possible to use graphene for example as in the case of an X-ray radiation passage window described above or as in the case of an above-described method for producing an X-ray radiation passage window.

BRIEF DESCRIPTION OF THE DRAWINGS

Further advantages and advantageous embodiments of the X-ray radiation passage window will become apparent from the embodiments described below in conjunction with FIGS. 1A to 9.

In the exemplary embodiments and figures, identical or identically acting constituent parts may in each case be provided with the same reference signs. The illustrated elements and their size relationships among one another should not be regarded as true to scale, in principle. Rather, individual elements such as, for example, layers, component parts and regions may be illustrated with exaggerated thickness or size dimensions in order to enable better illustration and/or in order to afford a better understanding.

DETAILED DESCRIPTION OF ILLUSTRATIVE EMBODIMENTS

Figure 1A:
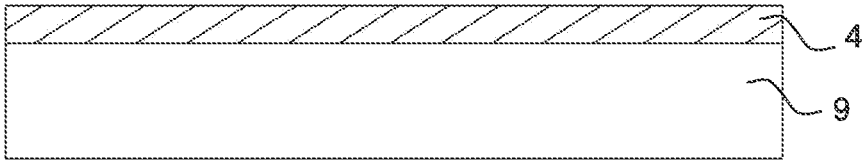
FIGS. 1A to 8B show schematic illustrations of X-ray radiation passage windows and methods for producing X-ray radiation passage windows in accordance with various exemplary embodiments.
Figure 1B:
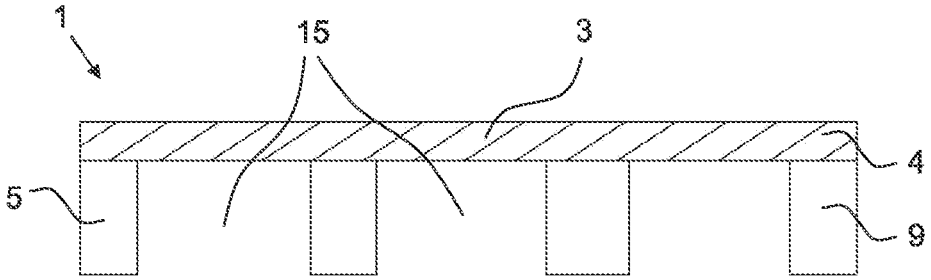
Figure 1C:
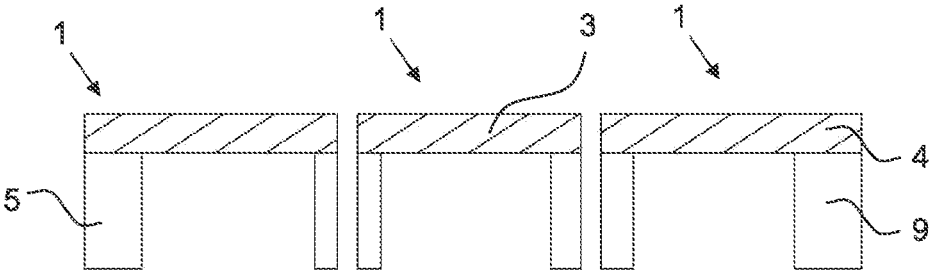

FIGS. 1A to 1C show a method for producing an X-ray radiation passage window 1 in accordance with a first exemplary embodiment, in which, in the first method step illustrated in FIG. 1A, a substrate 9 is provided and a layer 4 containing graphene is deposited on the substrate 9 by means of chemical vapor deposition (CVD). Preferably, a plurality of graphene monolayers are deposited, such that the resulting graphene-containing layer has a graphene multilayer construction. In this case, the graphene deposition may take place on one side or over the whole area on all surfaces of the substrate 9, wherein, in the case of a graphene deposition on all surfaces of the substrate 9, the graphene-containing layer 4 is preferably removed again at least on that side of the substrate 9 on which regions of the substrate 9 are subsequently removed. Furthermore, the graphene-containing layer 4 may also be used as an etching mask.

In the method step that follows the first method step and is illustrated in FIG. 1B, substrate material is removed in the regions 15 by means of a Bosch process, as a result of which openings for a beam path are produced. Alternatively, wet-chemical etching may also be used for removing the substrate. After the removal of one or a plurality of regions of the substrate 9, the graphene-containing layer 4 forms a radiation-transmissive window element 3, which may also be designated as a graphene membrane. The regions of the substrate 9 that have not been removed form a window holder element 5 connected to the graphene membrane. A strong binding of the graphene-containing layer 4 to the substrate 9 makes it possible to ensure that the regions of the layer 4 which adjoin the window holder element 5 do not flake off even in the event of a great pressure difference.

In the method step illustrated in FIG. 1C, the substrate 9 with the graphene membrane applied thereto is subsequently singulated into individual X-ray radiation passage windows 1. Also alternatively, the windows may be singulated by wafer sawing or a laser process or by a combination of the methods mentioned.

Figure 2A:
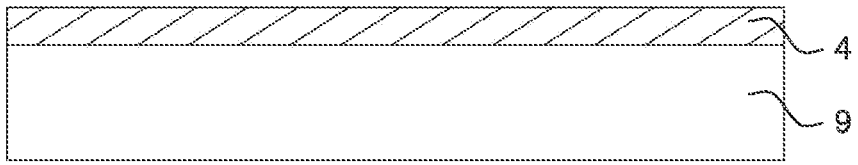
Figure 2B:
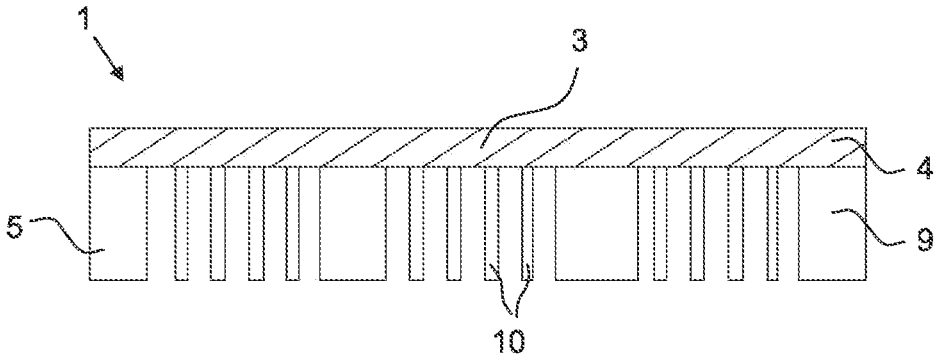
Figure 2C:
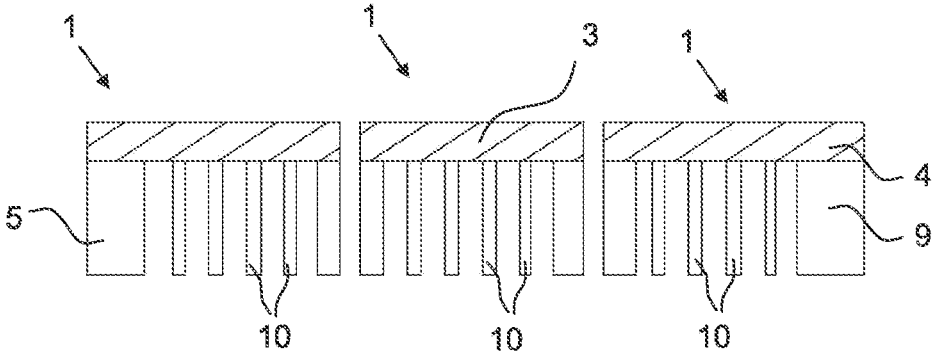
Figure 3A:
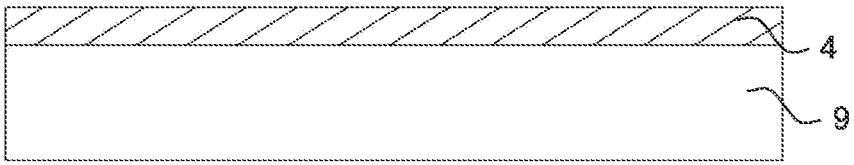
Figure 3B:
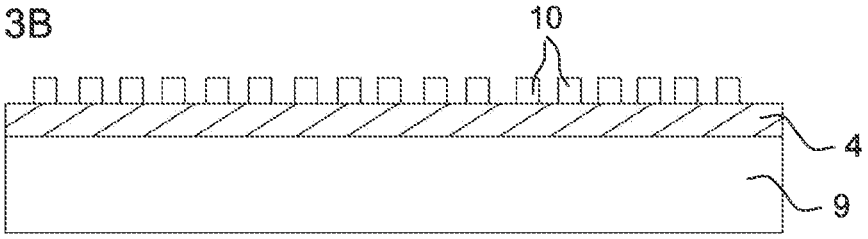
Figure 3C:
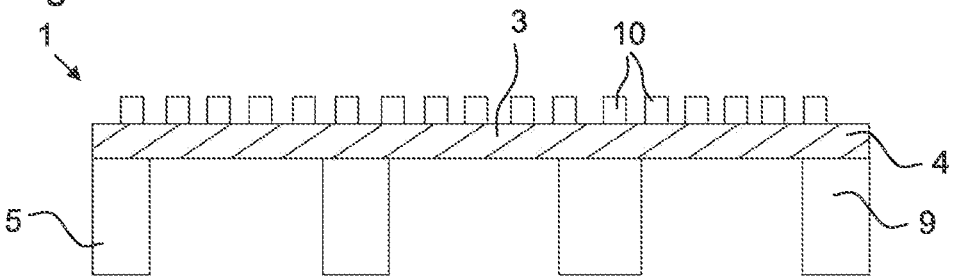
Figure 3D:
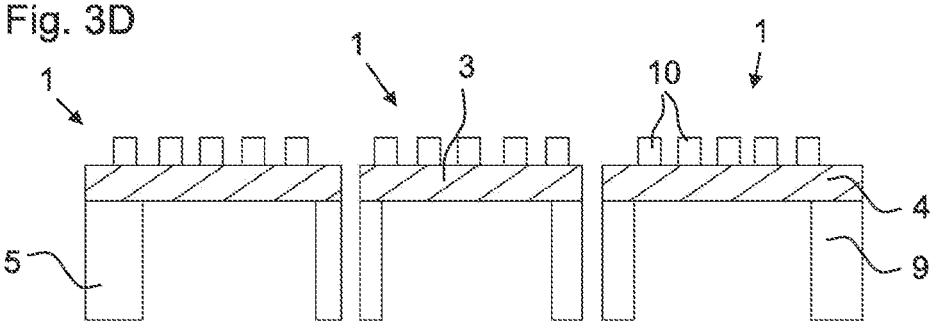
Figure 4A:
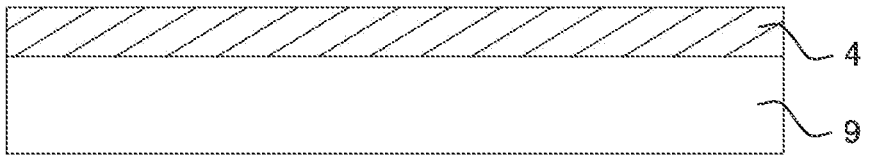
Figure 4B:
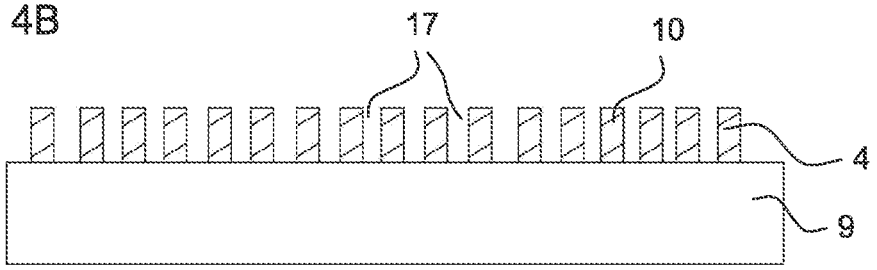
Figure 4C:
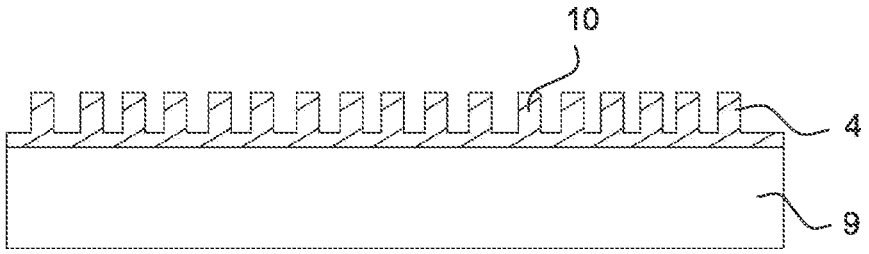
Figure 4D:
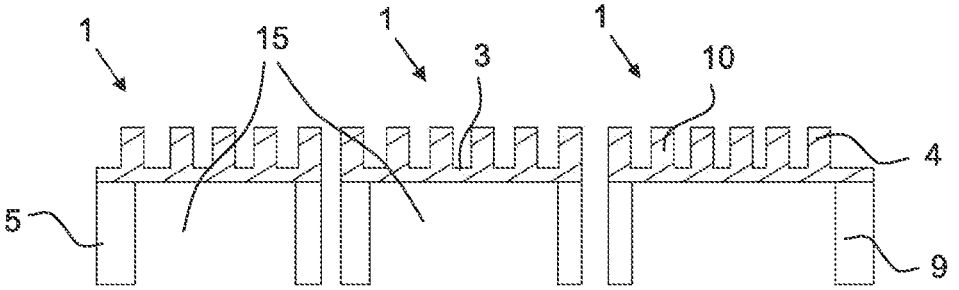
Figure 5A:
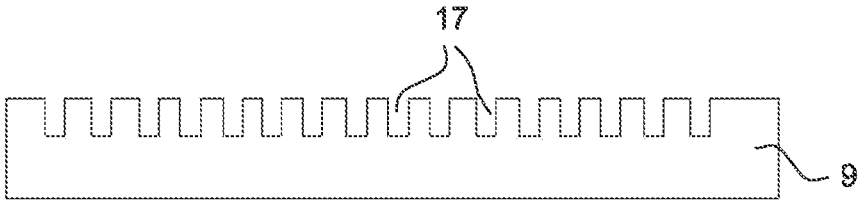
Figure 5B:
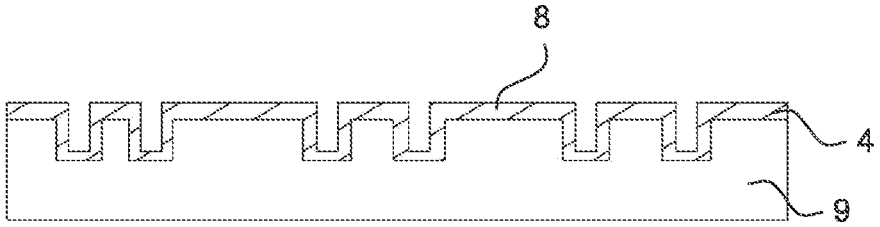
Figure 5C:
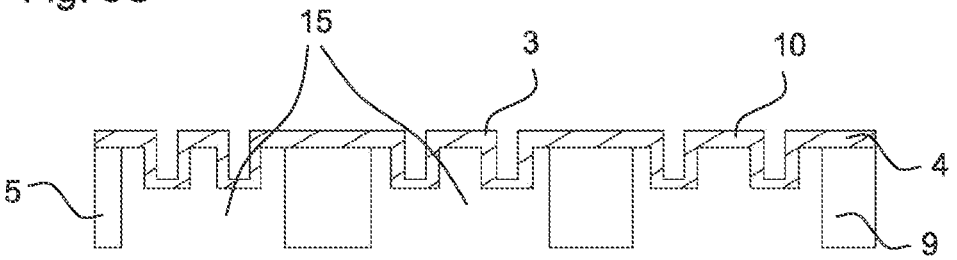
Figure 5D:
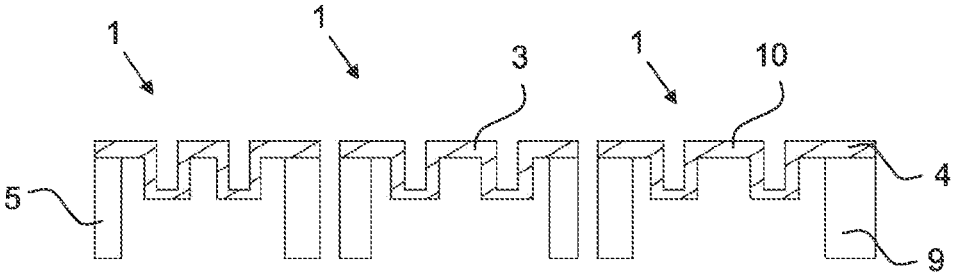
Figure 6A:
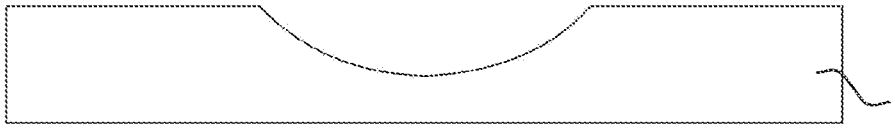
Figure 6B:
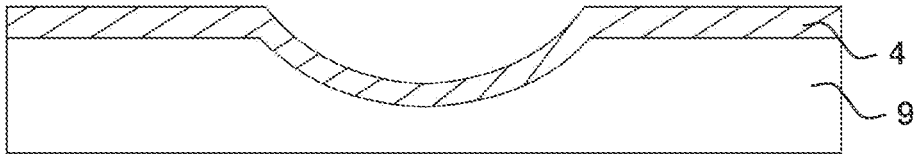
Figure 6C:
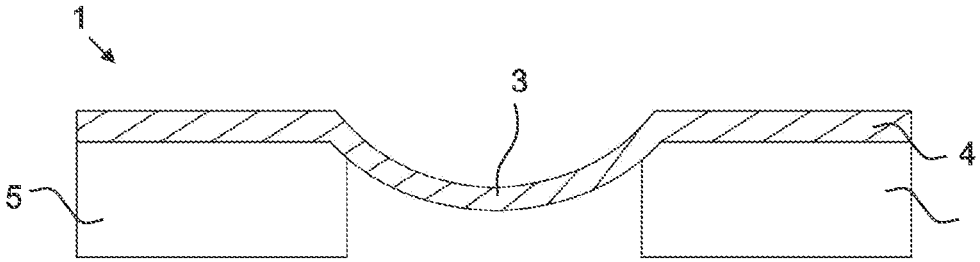
Figure 6D:
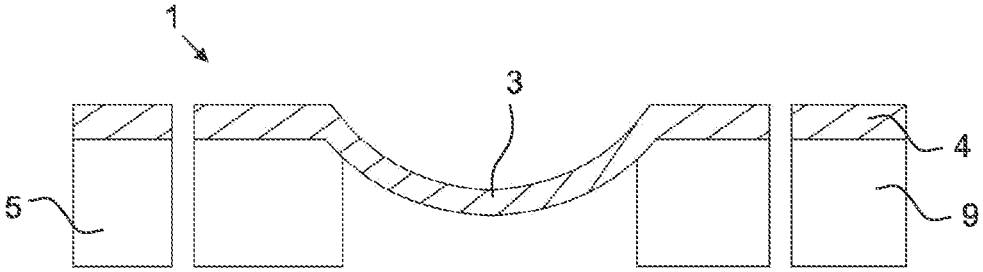
Figure 7A:
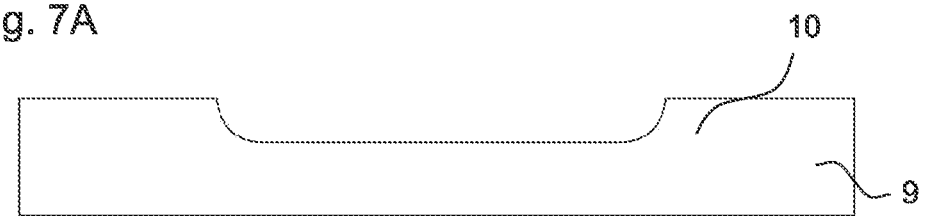
Figure 7B:
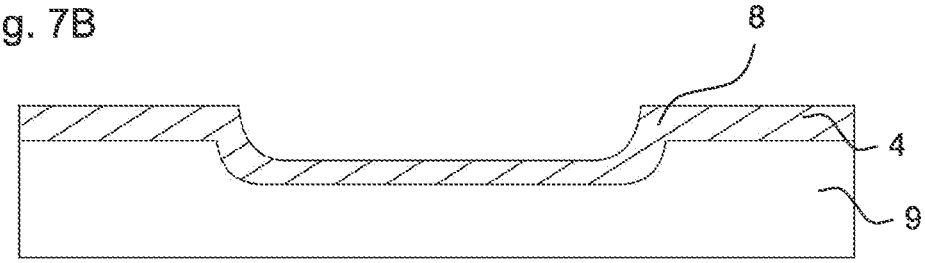
Figure 7C:
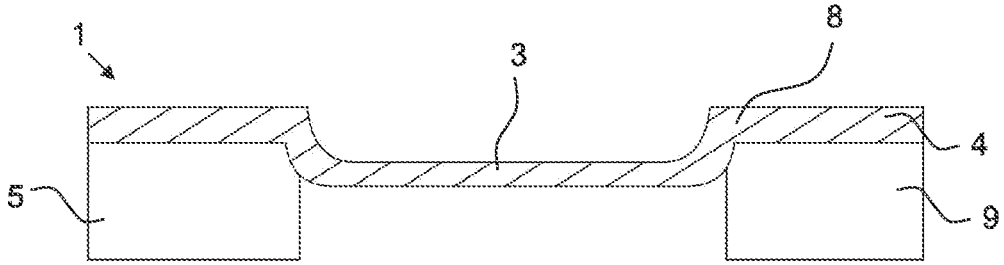
Figure 7D:
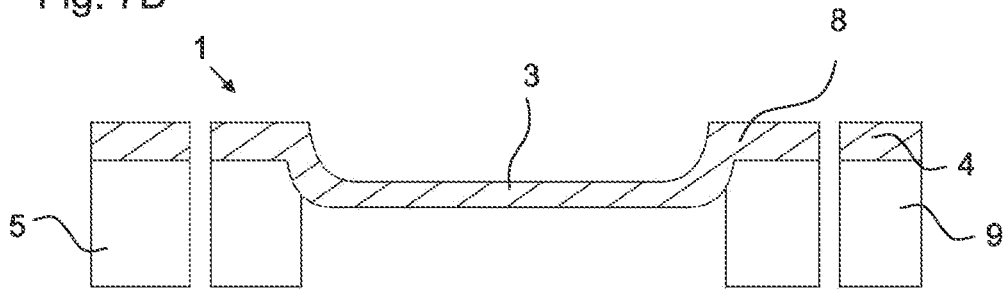

FIGS. 2A to 2C show a method for producing an X-ray radiation passage window 1 in accordance with a further exemplary embodiment. In the method illustrated in FIGS. 2A to 2C, in contrast to the method described in connection with FIGS. 1A to 1C, monolithic supporting structures 10 are created during the removal of the substrate material. In the exemplary embodiment shown, the supporting structures 10 are embodied as supporting webs. Alternatively, the supporting structures 10 may be embodied as diagonal lines, parallel lattices, crosses, rings, triangles, cuboids, rhombi, circles, honeycombs or combinations thereof. Advantageously, the graphene-containing layer 4, which forms a graphene membrane after the removal of the substrate regions 15, may be mechanically stabilized by means of the supporting structures 10.

FIGS. 3A to 3D show a method for producing an X-ray radiation passage window 1 in accordance with a further exemplary embodiment. In contrast to the exemplary embodiment in accordance with FIGS. 1A to 1C, after the graphene-containing layer 4 has been deposited, supporting structures 10 are integrated on the graphene-containing layer 4. Afterward, individual substrate regions each forming a beam path are removed and the substrate 9 with the graphene-containing layer 4 applied thereon and the supporting structures 10 are singulated into individual windows.

FIGS. 4A to 4D show a method for producing an X-ray radiation passage window 1 in accordance with a further exemplary embodiment. In this case, in contrast to the exemplary embodiment shown in connection with FIGS. 1A to 1C, the graphene-containing layer 4 is structured after deposition on the substrate 9 by removal of individual regions of the layer 4 in such a way that a supporting structure arises within the graphene-containing layer 4. In this case, by way of example, individual depressions 17 and individual regions arranged between the depressions 17 may arise within the layer 4. By way of example, the depressions 17 may extend as far as the substrate 9, such that individual, disconnected regions arise between the depressions 17, and residual material of the layer 4 is no longer embodied as a continuous layer. Subsequently, in a further method step illustrated in FIG. 4C, graphene is grown again, wherein graphene is deposited in particular between the individual, disconnected regions, such that a continuous graphene-containing layer 4 comprising a plurality of graphene supporting structures 10 is formed again. Afterward, individual regions 15 of the substrate are removed by means of etching, for example, such that a radiation-transmissive window element 3 is formed, and the substrate 9 is singulated, if appropriate, into a plurality of X-ray radiation passage windows 1.

FIGS. 5A to 5D show a method for producing an X-ray radiation passage window 1 in accordance with a further exemplary embodiment, wherein, in contrast to the exemplary embodiment in accordance with FIGS. 1A to 1C, the substrate 9 is structured before the graphene-containing layer 4 is deposited. The substrate 9 may be structured, for example, by wet-chemical, dry, isotropic or anisotropic etching, by embossing, milling or lasering. In this case, by way of example, depressions 17 may arise in the substrate 9, wherein the individual depressions 17 for example may each have an approximately identical depth and be arranged approximately equidistantly from one another. Subsequently, the graphene-containing layer 4 is applied to the substrate by being grown, for example, wherein the layer 4 may be applied to the substrate 9 for example uniformly or approximately uniformly, such that the layer 4, particularly if it has a thickness that is less than half of the width of the individual depressions 17, may have a for example "folded" form substantially adapted to the form of the structured substrate 9. Alternatively, the depressions 17, for example if the individual depressions 17 have a width smaller than twice the thickness of the layer 4, during the process of applying the layer 4, may be partly or wholly filled with the graphene-containing layer 4.

Afterward, regions 15 are removed by means of one of the methods already mentioned, thus giving rise to at least one radiation-transmissive window element 3, wherein the surface structure of the at least one window element 3 has a graphene supporting structure which, depending on the structuring of the substrate 9 which has already been partly removed, may have in cross section a rectangular, trapezoidal, triangular or partially circular shape or a combination of these shapes. In a subsequent method step, the substrate 9 may, if appropriate, again be singulated into a plurality of X-ray radiation passage windows 1.

FIGS. 6A to 6D and FIGS. 7A to 7D show methods for producing an X-ray radiation passage window 1 in accordance with two further exemplary embodiments, wherein, in contrast to the exemplary embodiments in accordance with FIGS. 1A to 1C, the substrate 9 is structured before graphene deposition. In the exemplary embodiment in FIGS. 6A to 6D, the substrate 9 has a concave cavity after it has been structured, to be precise in particular in a region in which the substrate 9 is removed after the graphene deposition. In the exemplary embodiments in FIGS. 7A to 7D, the substrate 9 has a depression having rounded corners after it has been structured, the depression again being situated in a region of the substrate 9 which is removed after the deposition of the graphene-containing layer. As an alternative to the exemplary embodiments shown, the substrate may also be structured in some other way, for example, by a plurality of depressions or a combination of the structurings shown in FIGS. 6A and 7A. The mechanical stability of the graphene membrane may advantageously be increased by means of the structuring.

Figure 8A:
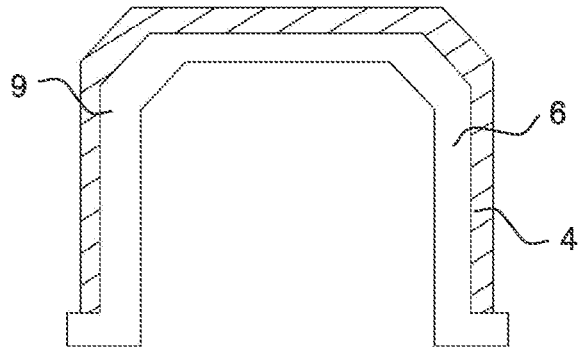
Figure 8B:
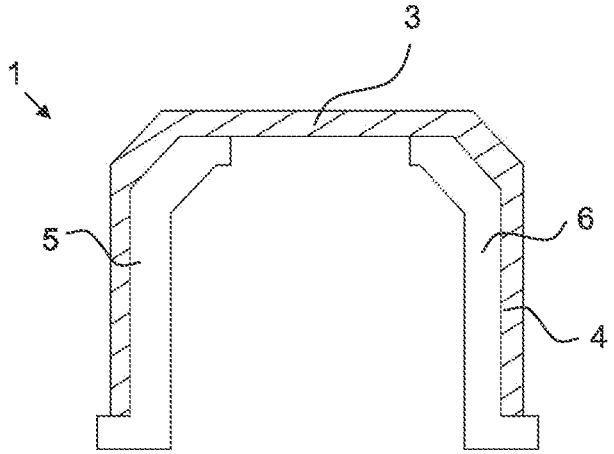

FIGS. 8A and 8B show a method for producing an X-ray radiation passage window 1 in accordance with a further exemplary embodiment. In this case, a graphene-containing layer 4 is deposited directly on a surface of a cap 6 containing a metal. Alternatively, the cap 6 may also contain a ceramic or comprise carbon. Furthermore, the cap 6 may have adhesion-promoting layers at its surface in order to increase an adhesion between the graphene-containing layer and the cap surface. In accordance with a further exemplary embodiment, the cap 6 may be a TO8 cap forming part of a TO8 housing. In the method step shown in FIG. 8B, a beam path for incident X-ray radiation is subsequently opened by the removal of part of the cap 6, for example by means of an etching method.

The methods illustrated in FIGS. 1A to 8B may be combined arbitrarily with one another. Furthermore, instead of the substrates 9 shown in FIGS. 1A to 8B, alternatively any other suitable substrates, such as plates or TO8 housings, for example, may be used.

Figure 9:
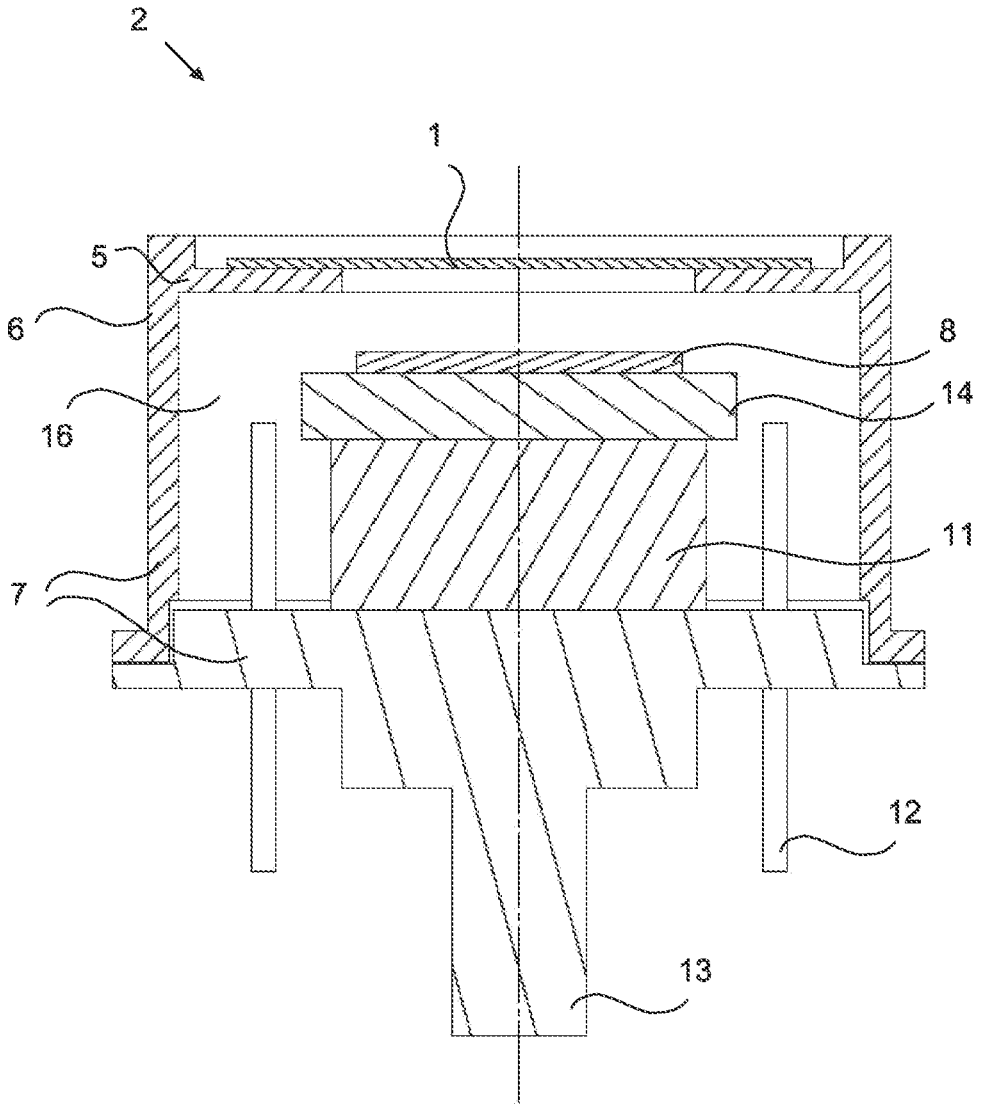
FIG. 9 shows a schematic sectional view of a radiation detector having an X-ray radiation passage window in accordance with a further exemplary embodiment.

FIG. 9 shows a radiation detector 2 in a lateral sectional view. The radiation detector 2 has a detector housing 7 comprising a cap 6, an X-ray radiation passage window 1 fixed to the cap 6, and a base 13 connected to the cap 6. The X-ray radiation passage window 1 may be embodied, in particular, like an above-described X-ray radiation passage window 1 having a graphene-containing, radiation-transmissive window element. A detector element 8 suitable for detecting a radiation, in particular an X-ray radiation, is arranged within the detector housing 7. Furthermore, contact pins 12 are fixed in the base 13, said contact pins serving as signal and control terminals and being electrically conductively connected to the detection element 8 for example by means of bonding wires (not illustrated) via a printed circuit board 14, on which the detection element 8 is arranged. The cap 6, the base 13 and the X-ray radiation passage window 1 form a cavity 16, which is closed off in a gas-tight manner and which may be evacuated or filled with protective gas. Furthermore, the radiation detector 2 has a thermoelectric cooler 11, which serves for cooling the detection element 8 and may advantageously reduce leakage currents that occur and noise associated therewith.

Figure 10A:
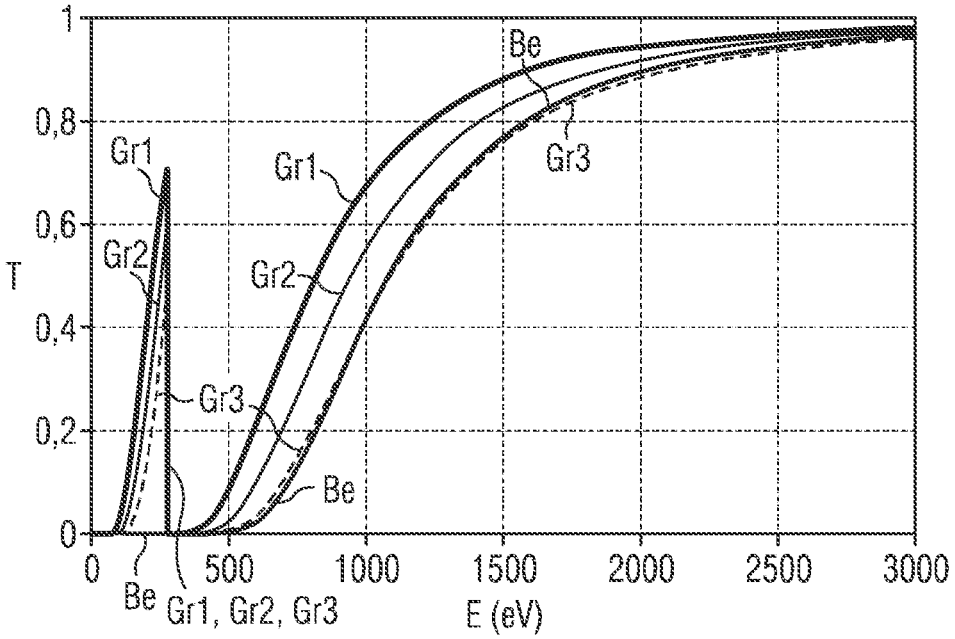
FIGS. 10A and 10B is a show graphical illustrations of the transmission of graphene in comparison with beryllium and AP3.3.
Figure 10B:
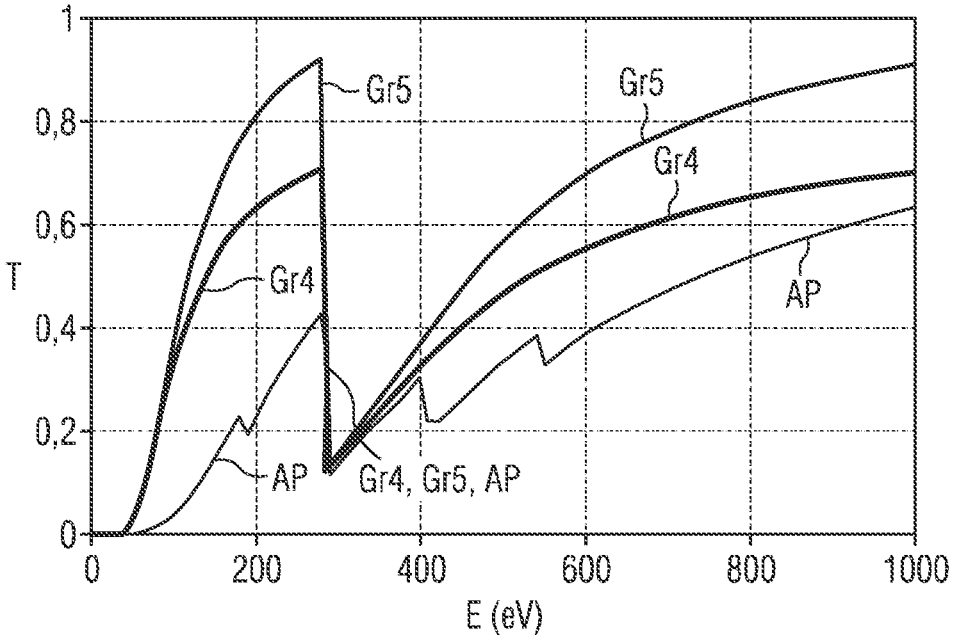

FIGS. 10A and 10B show the transmission T of graphene layers of different thicknesses as a function of the photon energy E of incident radiation (in eV) in comparison with beryllium and AP3.3.

The curves illustrated in FIG. 10A show the transmission T of a graphene layer of thickness 1 μm (Gr1), of thickness 1.5 μm (Gr2) and of thickness 2.2 μm (Gr3) in comparison with a beryllium layer of thickness 8 μm (Be). The thickness of the graphene layer should be approximately <2.2 μm without possible supporting structures, in order to achieve a transmission comparable to that of 8 μm thick beryllium. It is assumed here that the density of graphene is 2.2 g/cm$^3$.

FIG. 10B shows the transmission T of a graphene layer of thickness 200 nm (Gr4) having a filling factor of 76% (vacuum) and of a thickness 230 nm (Gr5) having a filling factor of 100% (vacuum) in comparison with an AP3.3 window (AP) having a filling factor of 76% (30 mbar, N2). The thickness of the graphene layer should be from approximately 200 nm (filling factor 76%) to approximately 230 nm without supporting structures, in order to obtain a transmission comparable to that of AP3.3. As necessary, the graphene membrane may be stabilized with supporting structures for example as described above.

Figure 11:
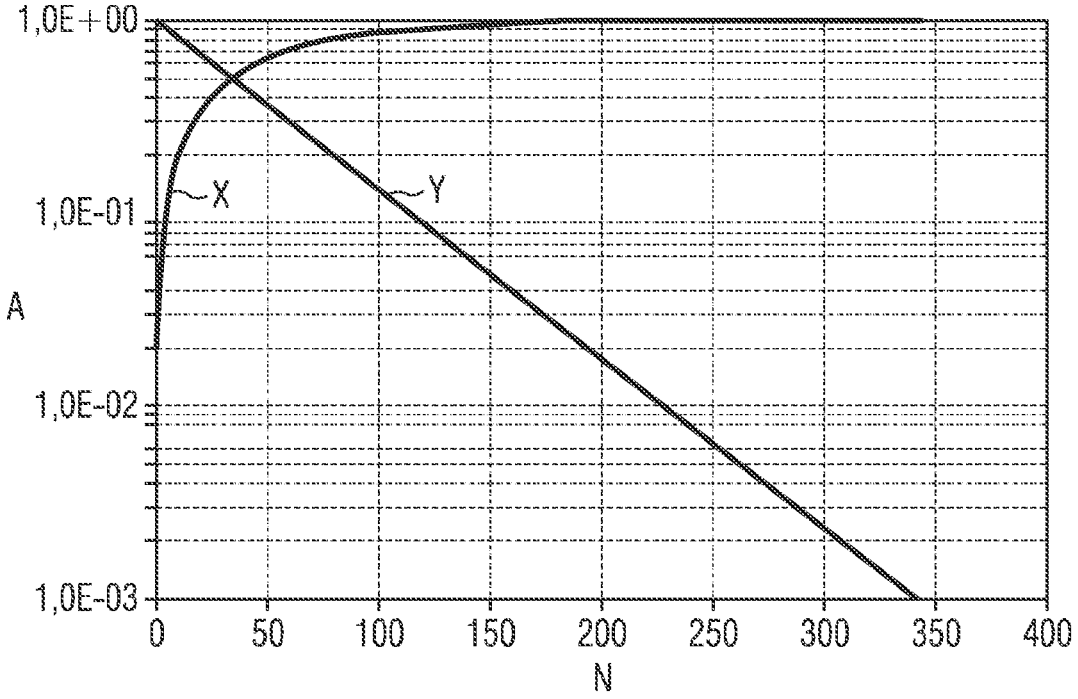
FIG. 11 shows a graphical illustration of the light absorption of graphene as a function of the number of graphene monolayers.

FIG. 11 shows, on the basis of the curve X, the absorption A of visible light as a function of the number N of graphene monolayers of a graphene-containing layer 4. Furthermore, the transmission 1-A as a function of the number N of graphene monolayers is illustrated on the basis of the curve Y. In order to achieve a good light impermeability with respect to visible light (approximately <1 ppm) without additional light-blocking elements, the graphene-containing layer 4 should comprise at least 350 graphene monolayers or consist of at least 350 graphene monolayers. It is assumed here that the light absorption per graphene monolayer is approximately 2%. Preferably, the graphene-containing layer 4 comprises between 350 and 400 graphene monolayers.

The features described in the exemplary embodiments shown may also be combined with one another in accordance with further exemplary embodiments, even if such combinations are not explicitly shown in the Figures. Furthermore, the X-ray radiation passage windows shown may have further or alternative features in accordance with the embodiments described in the general part above.

The invention is not restricted to the exemplary embodiments by the description on the basis of said exemplary embodiments, but rather encompasses any novel feature and also any combination of features, this including in particular any combination of features in the patent claims, even if this feature or this combination itself is not explicitly specified in the patent claims or exemplary embodiments.

What is claimed is:

1. An X-ray radiation passage window comprising a radiation-transmissive window element, wherein the radiation-transmissive window element has a graphene-containing layer and the graphene-containing layer comprises a graphene multilayer construction, wherein the graphene-containing layer comprises at least 350 graphene monolayers, and wherein the graphene-containing layer has a thickness of less than 2.2 μm.

2. The X-ray radiation passage window according to claim 1, wherein the graphene-containing layer has a layer thickness of greater than or equal to 100 nm.

3. The X-ray radiation passage window according to claim 1, wherein the radiation-transmissive window element further comprises a layer that blocks visible light in addition to the graphene-containing layer.

4. The X-ray radiation passage window according to claim 3, wherein the layer that blocks visible light contains aluminum.

5. The X-ray radiation passage window according to claim 1, wherein the radiation-transmissive window element further comprises a passivation layer in addition to the graphene-containing layer.

6. The X-ray radiation passage window according to claim 5, wherein the passivation layer contains boron nitride.

7. The X-ray radiation passage window according to claim 1, further comprising a window holder element, wherein the radiation-transmissive window element is directly connected to the window holder element.

8. The X-ray radiation passage window according to claim 7, wherein the graphene-containing layer is directly connected to the window holder element.

9. The X-ray radiation passage window according to claim 7, wherein the window holder element has a melting temperature of greater than or equal to 1,000° C.

10. The X-ray radiation passage window according to claim 7, wherein the window holder element contains at least one material selected from the group consisting of Si, $SiO_2$, quartz, $Si_2N_4$, SiC, $Al_2O_3$, AlN, Cu, Ni, Mo, and W.

11. The X-ray radiation passage window according to claim 7, wherein the window holder element is embodied as a cap comprising a metal or a ceramic.

12. A radiation detector comprising:

a detector housing;

an X-ray radiation passage window according to claim 1; and a detector element arranged in the detector housing and configured to detect X-ray radiation.

13. The X-ray radiation passage window according to claim 1, wherein the X-ray radiation passage window is a window for a radiation detector.

14. The X-ray radiation passage window according to claim 1, further comprising a window holder element, wherein the graphene-containing layer is connected to the window holder element, and wherein the window holder element contains:

one material selected from the group consisting of Si, $SiO_2$, quartz, $Si_2N_4$, SiC, $Al_2O_3$, AlN, Cu, Ni, Mo, and W;

one or a plurality of materials which are compatible with a process in which graphene is deposited onto the one or onto the plurality of said materials; and/or at least one carbide-forming material.

15. A method for producing an X-ray radiation passage window, the method comprising forming a radiation-transmissive window element, wherein forming the radiation-transmissive window element comprises:

providing a substrate;

depositing a graphene-containing layer over the substrate; and removing a portion of the substrate, wherein the graphene-containing layer comprises a graphene multilayer construction including at least 350 graphene monolayers, and wherein the graphene-containing layer has a thickness of less than 2.2 μm.

16. The method according to claim 15, wherein the graphene-containing layer has a layer thickness of greater than or equal to 100 nm.

17. The method according to claim 15, wherein, before removing the portion of the substrate, the method further comprises applying supporting structures on a side of the graphene-containing layer that faces away from the substrate.

18. The method according to claim 15, further comprising forming supporting structures while removing the portion of the substrate.

19. The method according to claim 15, wherein the substrate is structured before the graphene-containing layer is deposited.

20. An X-ray radiation passage window comprising a radiation-transmissive window element, wherein the radiation-transmissive window element has a graphene-containing layer, wherein the graphene-containing layer comprises a graphene multilayer construction including at least 350 graphene monolayers, wherein a supporting structure is formed within the graphene-containing layer such that the graphene-containing layer comprises depressions and regions between depressions, and wherein the graphene-containing layer has a thickness of less than 2.2 μm.

21. An X-ray radiation passage window comprising a radiation-transmissive window element, wherein the radiation-transmissive window element has a graphene-containing layer, wherein the graphene-containing layer comprises a graphene multilayer construction including at least 350 graphene monolayers, wherein the X-ray radiation passage window further comprises a window holder element, wherein the graphene-containing layer is directly connected to the window holder element, wherein the graphene-containing layer has a thickness of less than 2.2 μm, and wherein the window holder element contains:

one material selected from the group consisting of Si, $SiO_2$, quartz, $Si_2N_4$, SiC, $Al_2O_3$, AlN, Cu, Ni, Mo, and W, one or a plurality of materials which are compatible with a process in which graphene is deposited onto the one or onto the plurality of said materials, and/or at least one carbide-forming material.

22. An X-ray radiation passage window comprising a radiation-transmissive window element, wherein the radiation-transmissive window element has a graphene-containing layer, wherein the graphene-containing layer consists of a plurality of graphene layers arranged on one another, wherein the graphene-containing layer comprises at least 350 graphene monolayers, wherein the graphene-containing layer is mechanically stable under pressure differences greater than 1 bar, and wherein the graphene-containing layer has a thickness of less than 2.2 μm.

* * * * *